US008123145B2

(12) United States Patent
Igwenezie

(10) Patent No.: US 8,123,145 B2
(45) Date of Patent: Feb. 28, 2012

(54) TIE PLATE WITH CAM SHOULDER BRIDGE

(76) Inventor: Jude Odihachukwunma Igwenezie, Brampton (CA)

( * ) Notice: Subject to any disclaimer, the term of this patent is extended or adjusted under 35 U.S.C. 154(b) by 226 days.

(21) Appl. No.: 12/398,377

(22) Filed: Mar. 5, 2009

(65) Prior Publication Data

US 2010/0224690 A1 Sep. 9, 2010

(51) Int. Cl.
*E01B 9/00* (2006.01)

(52) U.S. Cl. ..... 238/349; 238/351; 238/287

(58) Field of Classification Search ..... 238/349, 238/351, 341, 310, 317, 338, 287, 304
See application file for complete search history.

(56) References Cited

U.S. PATENT DOCUMENTS 4,143,818 A * 3/1979 Matsubara et al. ..... 238/349
6,305,613 B1 10/2001 Igwenezie
6,431,463 B2 * 8/2002 Igwemezie ..... 238/264

* cited by examiner

*Primary Examiner* — Mark Le
(74) *Attorney, Agent, or Firm* — Jeffrey Furr, Esq.; Furr Law Firm

(57) ABSTRACT

The invention is tie plates that are used to secure railway rails to the cross ties. The plate is cast with vertical abutment walls each of which has a slot along the inner wall originating from the lower outside edge and rising towards the top and center of each vertical abutment member. Between each pair of abutment members on either side of the rail seat is an upwardly facing ramp to facilitate insertion of the clip. Each ramp surface has a half cylindrical button cast on top of it. The button is used to retain the clip prior to shipment. The bottom of the plate has wedge shaped projections that tapper laterally solely in the same direction as the rail seat. The plate also has a portion laterally outward of each abutment member formed with a pit in its upper side for locating the outer end of the clip.

10 Claims, 16 Drawing Sheets

TIE PLATE WITH CAM SHOULDER BRIDGE

CROSS REFERENCE TO RELATED APPLICATION

None

TECHNICAL FIELD

The invention relates generally to a tie plates used to secure railway rails to the cross ties.

BACKGROUND ART

In prior art, known wood tie plates and rail fastening systems have offered difficulties to insertion of rail clips. The current invention facilitates insertion of the clips to provide the desired amount of clip pressure on the rail base.

There is still room for improvement in the art.

SUMMARY OF THE INVENTION

In the present invention, to provide the desired amount of clip pressure on the rail base tie plates are used to secure railway rails to the cross tie where the plate is cast with vertical abutment walls each of which has a slot along the inner wall originating from the lower outside edge and rising towards the top and center of each vertical abutment member. Between each pair of abutment members on either side of the rail seat is an upwardly facing ramp to facilitate insertion of the clip. Each ramp surface has a half cylindrical button cast on top of it. The button is used to retain the clip prior to shipment and the bottom of the plate has wedge shaped projections that tapper laterally solely in the same direction as the rail seat.

BRIEF DESCRIPTION OF DRAWINGS

In the drawings, like characters of reference indicate corresponding parts in the different figures.

BEST MODE FOR CARRYING OUT THE INVENTION

The present invention relates to a tie plates used to secure railway rails to the cross ties. The plate 10 comprises of a base plate adapted to be applied to the tie and a pair of abutment members upstanding there from to accommodate a rail between them. The upright abutment members have an open top to accommodate a bridging member with a downward face profiled to provide a reaction to a laterally inwardly inserted rail clip, and an upwardly facing lower ramp surface inclining from a laterally outer side of each abutment member upwardly inwardly to a laterally inner side thereof for facilitating insertion of the clip to an installed position wherein an inner end of the clip bears resiliently on the top side of the rail base flange. The plate 10 has a central portion between the abutment walls that tapers laterally in thickness and has an upper side canted with respect to the lower side and the said lower side is provided with discrete wedge shaped projections that spaced inwardly from a longitudinal edge of said plate 10. The wedge shaped projections tapper laterally solely in the same direct ion as the central portion, each wedge having an end face making an angle of approximately 90 degrees with said lower face and wherein the base plate has holes for insertion of cut spikes and/or threaded coach screws for securing said plate to the tie.

Whereas known wood tie plates and rail fastening systems of which the applicant is aware have offered difficulties to insertion of rail clips, the ramp surface of the present invention facilitates insertion of the clips and the removable bridging member can be profiled to provide the desired amount of clip pressure on the rail base.

Figure 1:
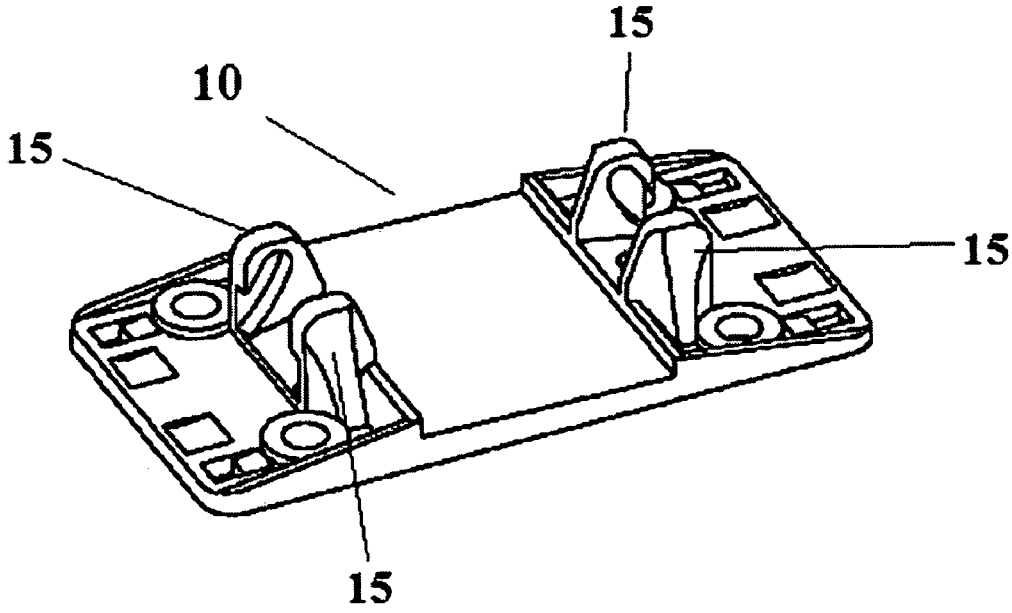
FIG. 1 is an isometric view of the wood tie plate in accordance with the invention.
Figure 2:
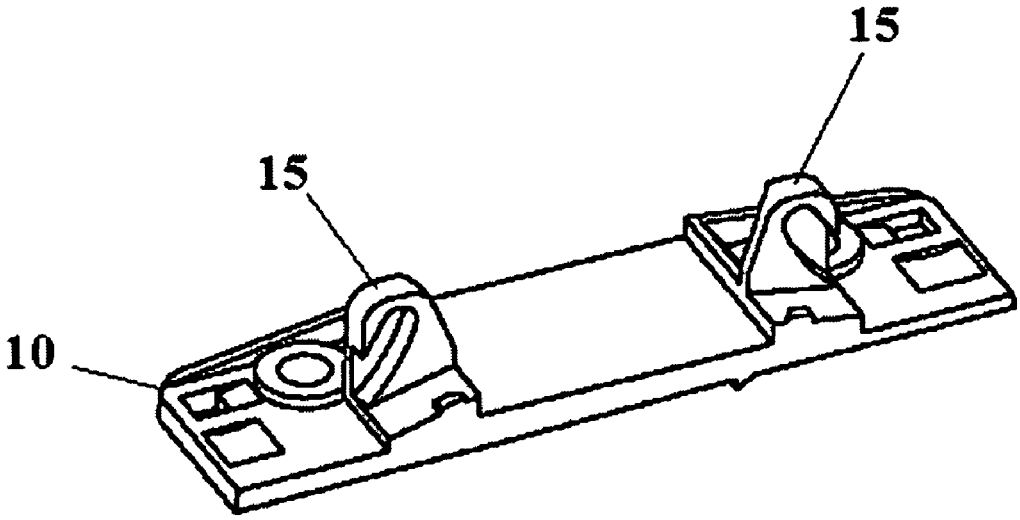
FIG. 2 is a half section of the wood tie plate in FIG. 1.
Figure 3:
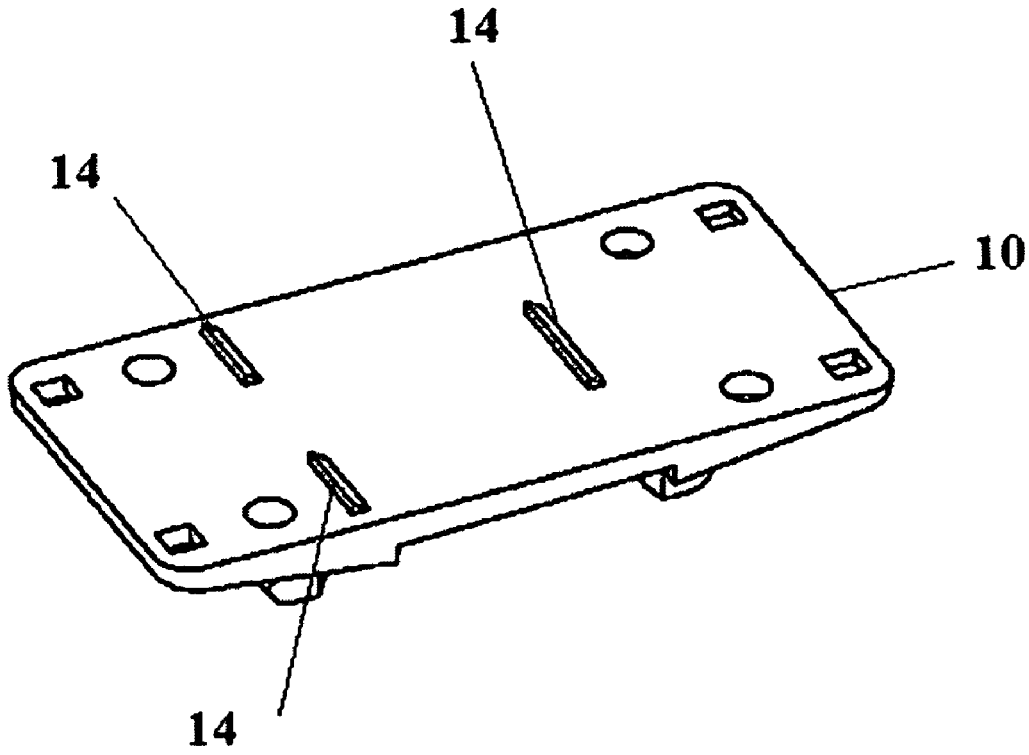
FIG. 3 is an isometric bottom view of the wood tie plate in FIG. 1 showing the wedge shaped projections.

This invention is an improvement over U.S. Pat. Nos. 6,305,613 and 6,431,463. In the present invention, the plate 10 shown in FIG. 1 is cast with vertical abutment walls each of which has a slot along the inner wall originating from the lower outside edge and rising towards the top and center of each vertical abutment member 15. Between each pair of abutment members 15 on either side of the rail seat is an upwardly facing ramp shown in FIG. 2 to facilitate insertion of the clip 20. Each ramp surface has a half cylindrical button cast on top of it. Said button is used to retain the clip 20 prior to shipment. The bottom of the plate 10 has wedge shaped projections 14 shown in FIG. 3 that tapper laterally solely in the same direction as the rail seat. The plate 10 also has a portion laterally outward of each abutment member 15 formed with a pit in its upper side for locating the outer end of said clip 20.

Figure 4A:
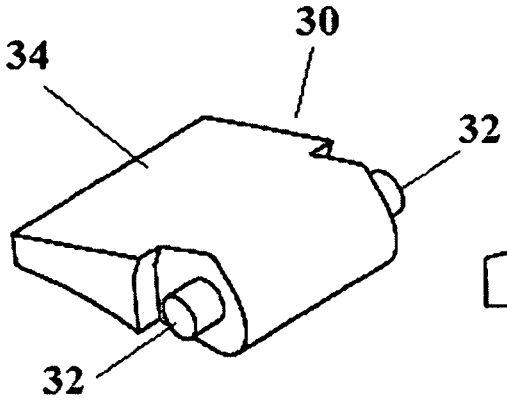
FIG. 4*a* is an isometric front view of the shoulder bridging member in accordance with this invention.
Figure 4B:
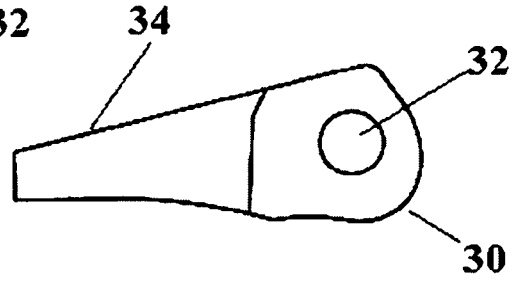
FIG. 4*b* is a side view of the shoulder bridging member in FIG. 4 showing the cam profile.
Figure 5:
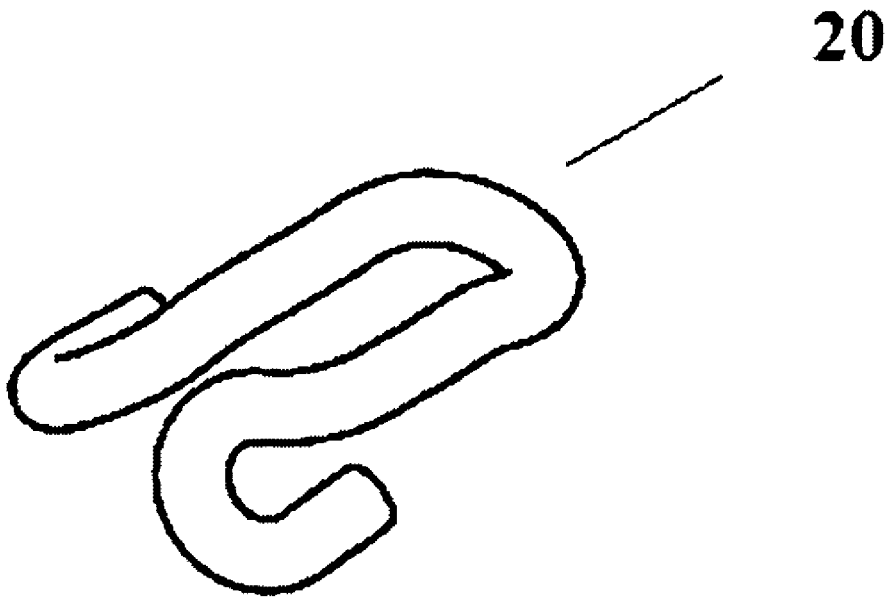
FIG. 5 is an isometric view of a rod formed clip.
Figure 6:
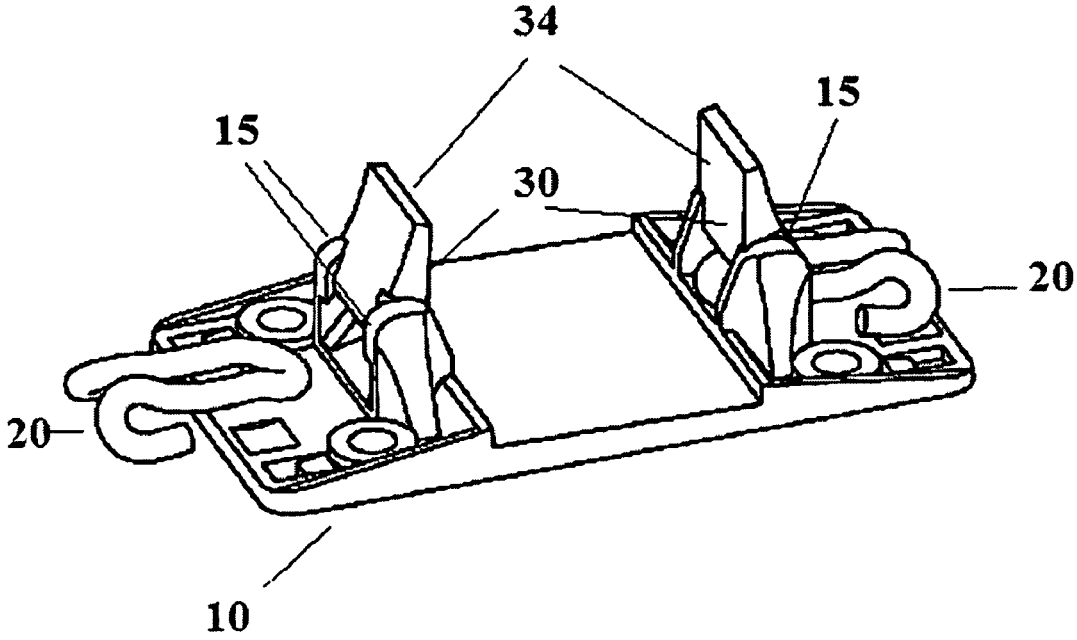
FIG. 6 is an isometric view of the plate in FIG. 1 with shoulder bridging member in place and the arm of the cam lifted to receive the clips in the pre-set position.
Figure 7:
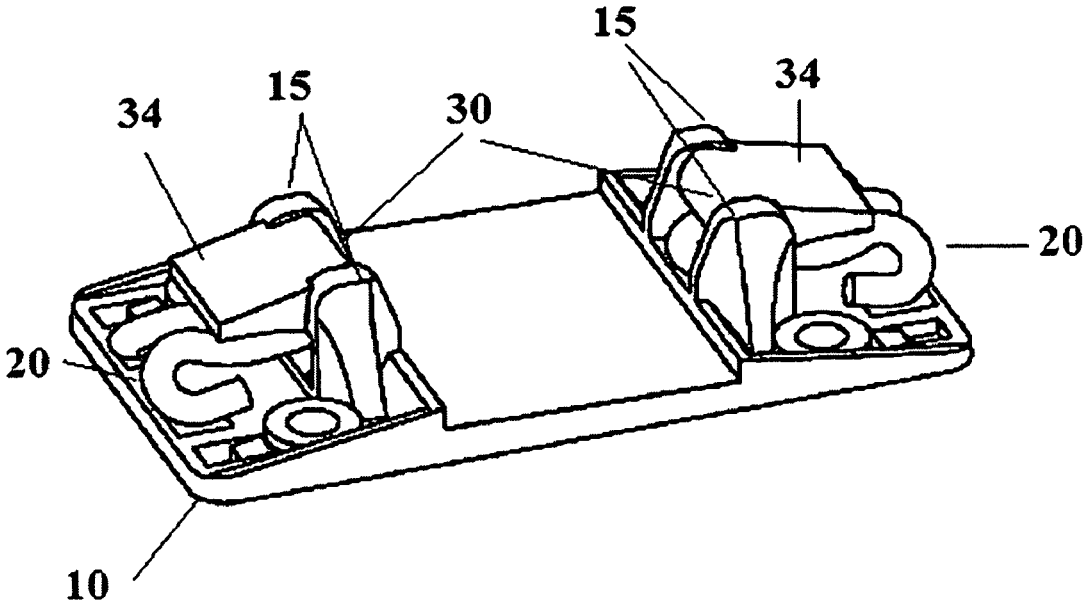
FIG. 7 is an isometric view of the plate in FIG. 6 with arm of the shoulder bridging lowered and the clips secured in the pre-install position.
Figure 8:
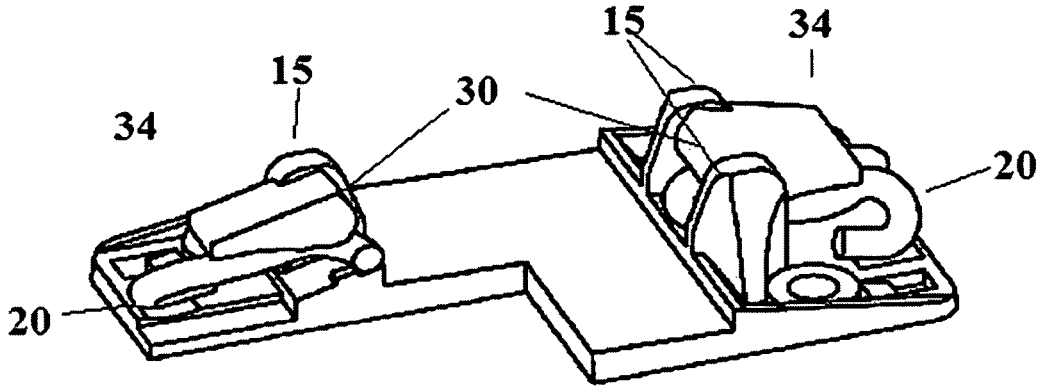
FIG. 8 is an isometric view of a quarter cutaway of the assembly in FIG. 7.
Figure 9:
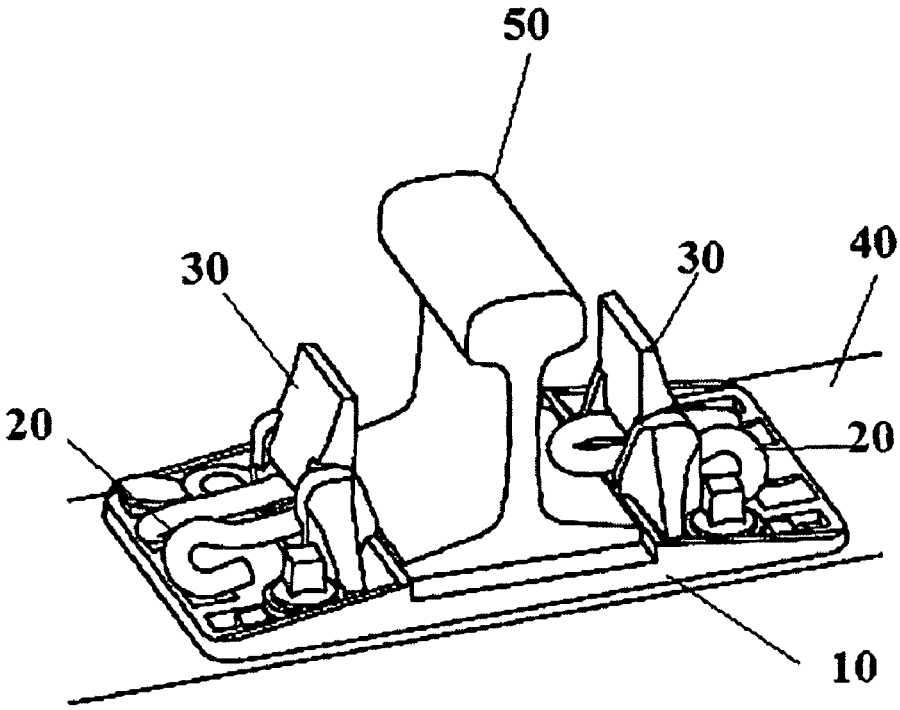
FIG. 9 is an isometric view of the plate in FIG. 7 now secured on a wood tie and the arm of the bridging member lifted to allow complete and final insertion of the clip onto the top of the rail base flange.
Figure 10:
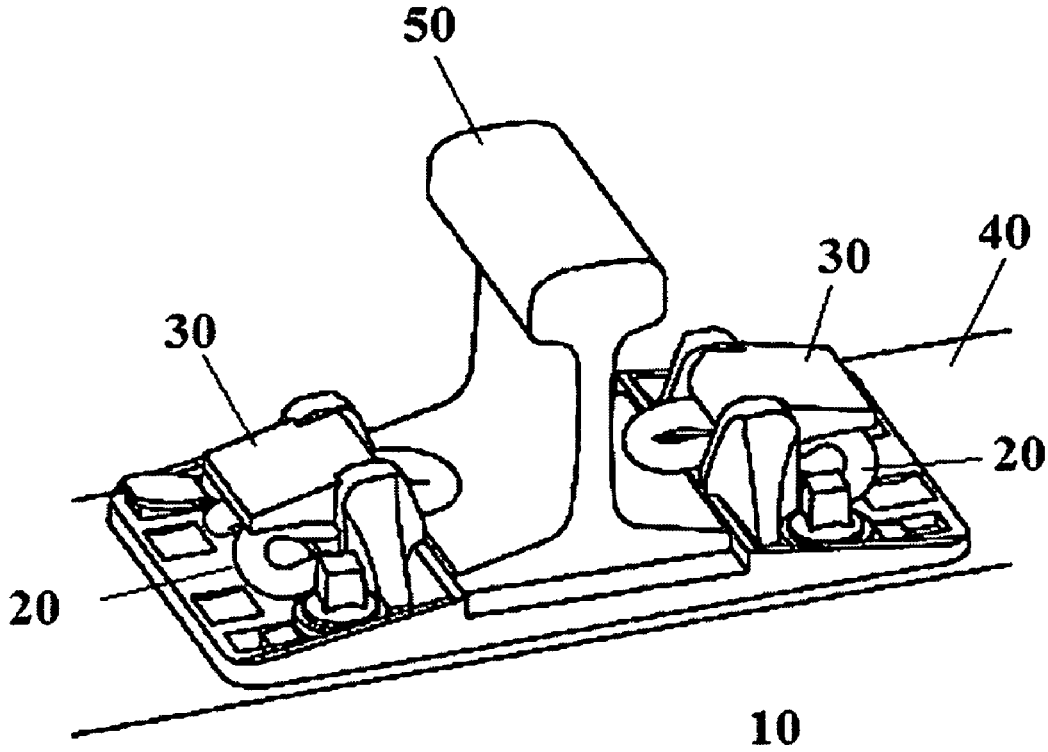
FIG. 10 is an isometric view of the plate in FIG. 7 now secured on a wood tie and the arm of the bridging member lowered to secure the clip in the final position.

Each inner wall slot of the vertical abutment members 15 stops short of the top of the abutment and receives the bridging member 30 shown in FIG. 4. The bridging member 30 has cylindrical projections 32 on either side that fit into the vertical shoulder slots. The bridging member 30 has a cam profiled portion, referred to as the cam 34 that reacts against the clip 20 and serves to apply the appropriate pressure. The cam profile determines the clip (FIG. 5) pressure. Lifting the arm of the cam 34 as shown in FIG. 6 allows insertion of the clips 20 to the pre-install position while lowering the arm of the cam secures the clip 20 as shown in FIG. 7 for shipping to the field. The quarter plate cut away in FIG. 8 shows how the clip 20 interacts with the ramp surface, the clip retention button and the cam 34. During installation in the field, the plate 10 is first secured to the tie 40 and the rail 50 inserted as shown in FIGS. 9 and 10. Once again, the arm of the cam 34 can be lifted to allow complete insertion of the clip 20 to the top of the rail base as shown in FIG. 9. Finally, the arm of the cam is lowered to apply pressure to the clip 20 and to secure it to the rail as shown in FIG. 10. Removal of the clip 20 for rail maintenance follows the reverse procedure.

Figure 11:
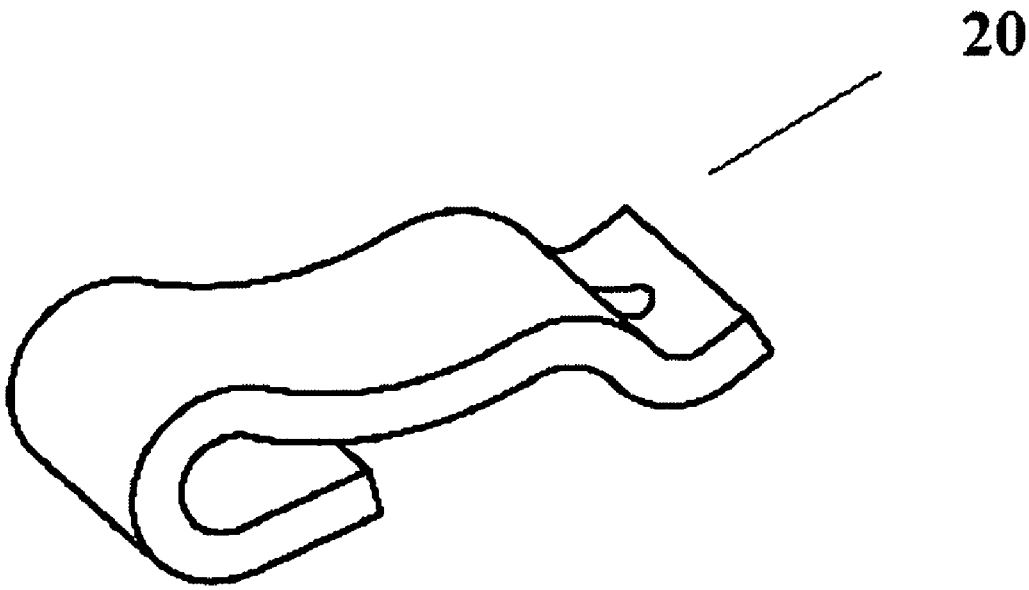
FIG. 11 is an isometric view of a rectangular bar formed clip.
Figure 12:
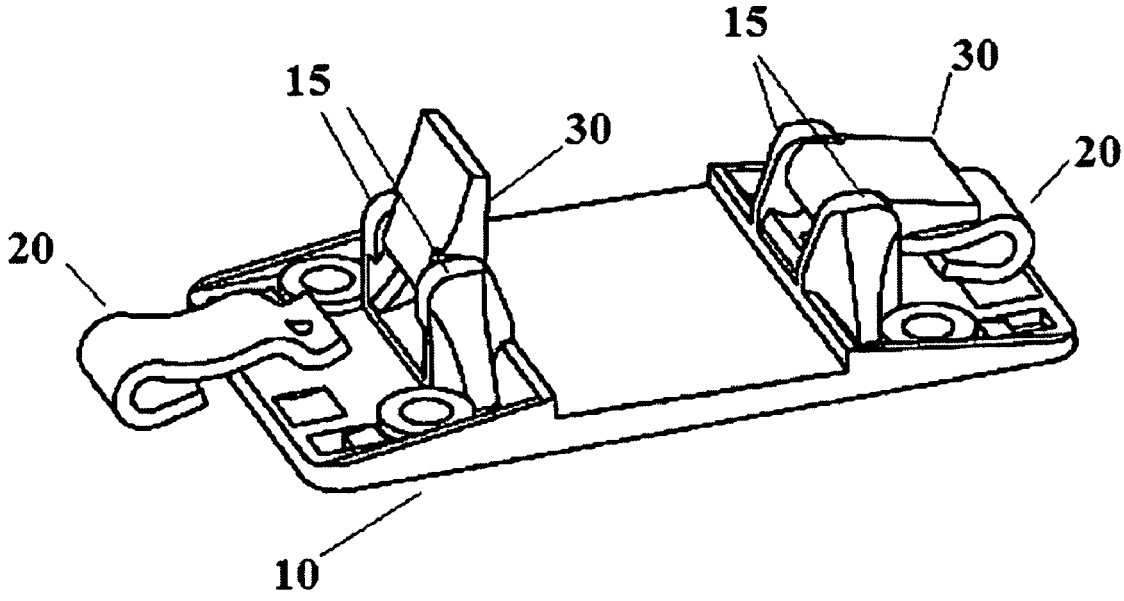
FIG. 12 is an isometric view of the pre-installation of the clip in FIG. 11 into the plate in FIG. 1.
Figure 13:
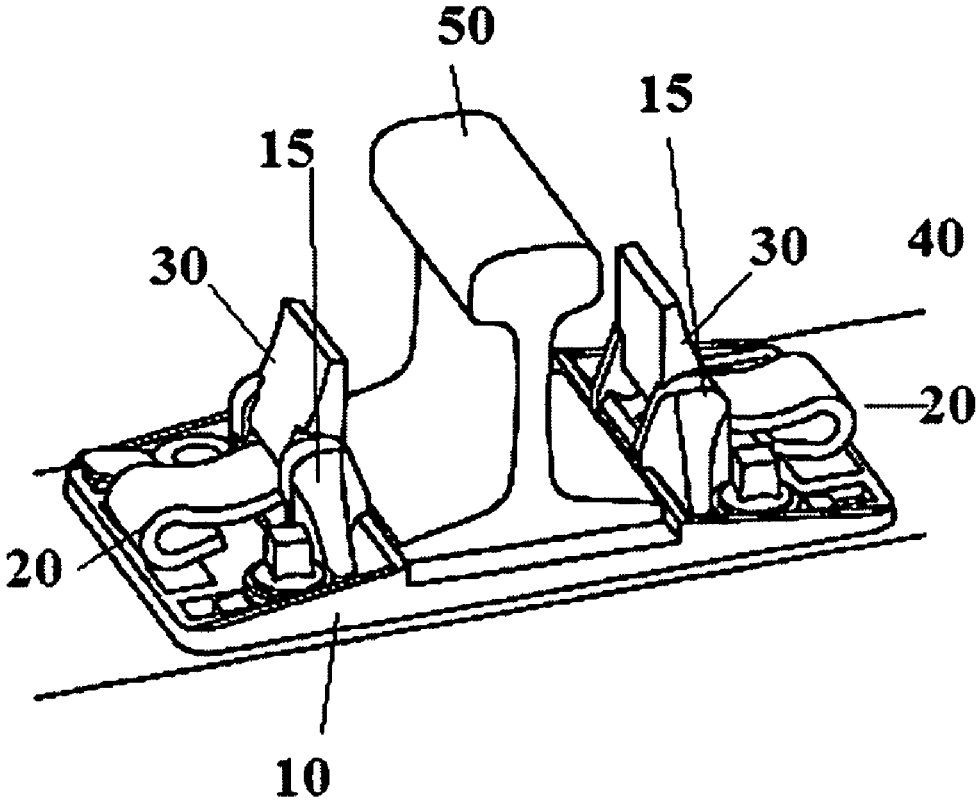
FIG. 13 is an isometric view of the plate in FIG. 12 now secured on a wood tie and the arm of the bridging member up.
Figure 14:
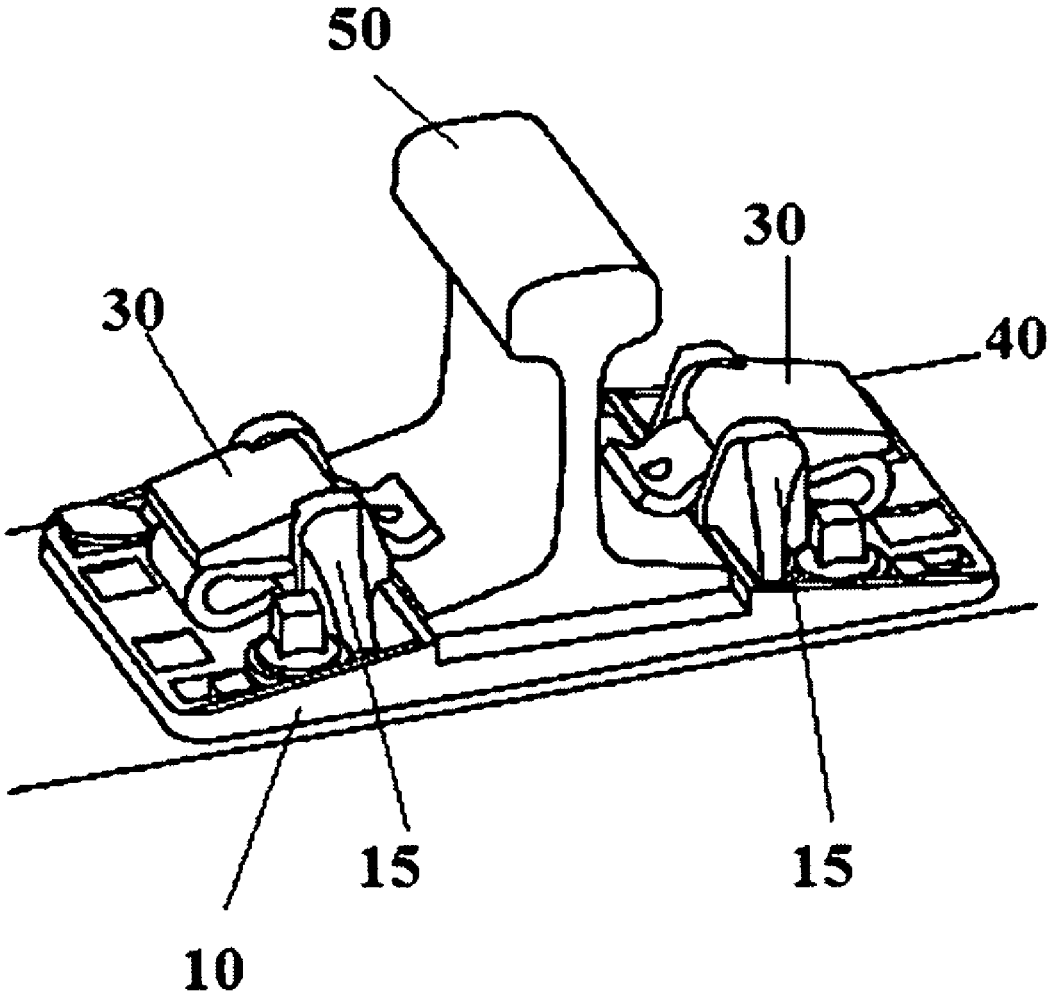
FIG. 14 is an isometric view of the plate in FIG. 12 now secured on a wood tie and the arm of the bridging member lowered to secure the bar formed clip in the final position.

This cam profiled bridge member 30 design is not limited to rod formed Clips 20. Clips 20 formed from other shapes can also be used. An example is the clip 20 formed from the rectangular flat bar shown in FIG. 11. In this case, a hole is made at the nose of the clip 20 to accommodate the button on the plate ramp surface between the vertical abutment members 15. Again, the arm of the cam 30 is lifted to pre-install the clip 20 as shown in FIGS. 12 and 13. The final installation procedure is the same as previously described with the final assembly for this clip 20 form shown in FIG. 14.

Figure 15:
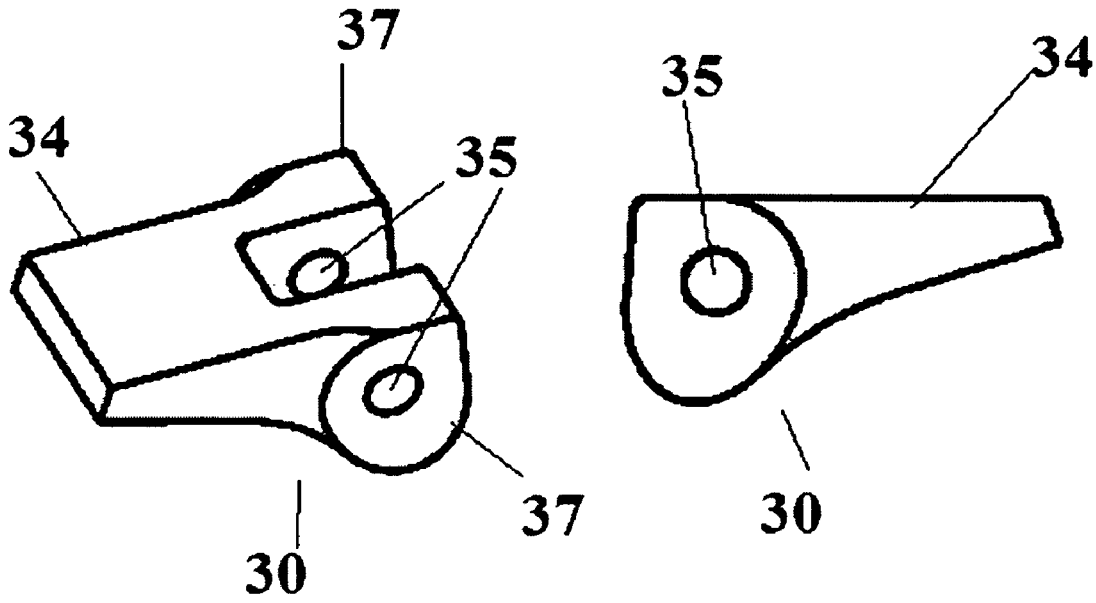
FIG. 15 displays a bridging member with a split cam.
Figure 16:
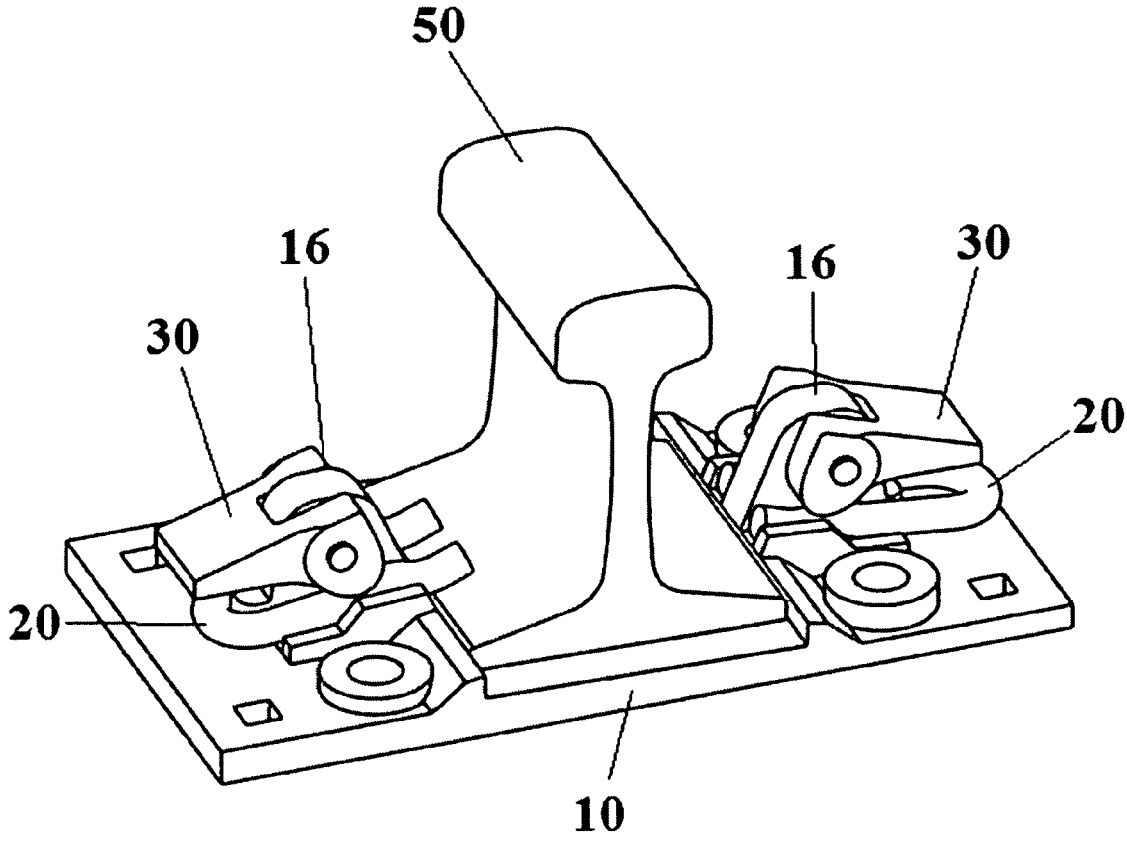
FIG. 16 is an isometric view of the plate in FIG. 12 now secured on a wood tie and the arm of the bridging member lowered to secure the bar formed clip in the final position using a split cam.

A bridging member 30 that has a cam split cam 34 can be also used in the current invention. In a split cam 20 the bridging member 30 has and opening on the non-cam side with holes 35 drilled into the two bridging member extensions 37 as shown in FIG. 15. A single vertical abutment member 16 extends from the plate 10 on to which the bridging member 30 is attached as shown in FIG. 16.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims.

What is claimed:

1. A railway tie plate suitable for attachment to a tie comprising: a base plate adapted to be applied to the tie and a pair of abutment members upstanding there from to accommodate there between a rail having a rail flange portion on each side, each upright abutment member providing a slot for receiving a bridging member that has a lower laterally inward surface comprising a cam for reaction with a laterally inwardly inserted clip, and an upwardly facing lower ramp surface defining a lower side of an opening extending through said abutment member and inclining from a laterally outer side of each abutment member upwardly to a termination on a laterally inner side thereof at least as high as said upper side of said rail flange portion engaged thereby, where each ramp surface has a half cylindrical button cast on top of it where said button is used to retain the clip, with said lower ramp surface terminated at a planar surface of an upper side of said plate position wherein an inner end of the clip bears resiliently on an inner side of the rail flange and, said plate having a central portion between the abutment members that tapers in thickness and has an upper side canted with respect to the lower side thereof and said lower side is provided with discrete wedge shape projections spaces inwardly from a longitudinal edge of said plate said projections having vertical surfaces facing in a direction of increasing thickness of the central portion of the plate.

2. A railway tie plate suitable for attachment to a tie according to claim 1 wherein said cam has a profile such that it relieves a clip vertical load when an arm is lifted to a vertical position.

3. A railway tie plate suitable for attachment to a tie according to claim 1 wherein the cam profile applies pressure to atop of the inserted clip when an arm is lowered to a horizontal position.

4. A railway tie plate suitable for attachment to a tie as claimed in claim 1 comprising a plate portion laterally outward of each abutment member formed with a pit in its upper side for location of an outer end of said clip.

5. A railway tie plate suitable for attachment to a tie as claimed in claim 1 wherein a central portion between the abutment members has an upper side offset upwardly from an outer plate portion upwardly toward said central portion longitudinally outward from the abutment member, and a rectangular opening in each transition portion for reception of a spike.

6. A railway tie plate suitable for attachment to a tie as claimed in claim 1 wherein said wedge shape projections taper laterally solely in the same direction as the central portion, each wedge shape projection having an end face making an angle no greater than 90 degrees with said lower side.

7. A railway tie plate suitable for attachment to a tie as claimed in claim 6 wherein said angle is substantially 90 degrees.

8. A railway tie plate suitable for attachment to a tie according to claim 1 wherein a laterally inner and lower surface of the bridging member is profiled to the shape of a cam with a split end.

9. A railway tie plate suitable for attachment to a tie according to claim 1 wherein the cam profile applies pressure to a top of the inserted clip when an arm is lowered to a horizontal position.

10. A railway tie plate suitable for attachment to a tie as claimed in claim 1 comprising a plate portion laterally outward of each abutment member formed with a pit in its upper side for location of an outer end of said clip.

* * * * *